US011365883B2

(12) United States Patent
Chapelle et al.

(10) Patent No.: US 11,365,883 B2
(45) Date of Patent: Jun. 21, 2022

(54) TURBINE ENGINE COMBUSTION CHAMBER BOTTOM

(71) Applicant: SAFRAN AIRCRAFT ENGINES, Paris (FR)

(72) Inventors: François Xavier Chapelle, Moissy-Cramayel (FR); Yvan Yoann Guezel, Moissy-Cramayel (FR); Romain Nicolas Lunel, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/058,021

(22) PCT Filed: May 22, 2019

(86) PCT No.: PCT/FR2019/051176
§ 371 (c)(1),
(2) Date: Nov. 23, 2020

(87) PCT Pub. No.: WO2019/224484
PCT Pub. Date: Nov. 28, 2019

(65) Prior Publication Data

US 2021/0199297 A1 Jul. 1, 2021

(30) Foreign Application Priority Data

May 23, 2018 (FR) ..... 1854298

(51) Int. Cl.
*F23R 3/00* (2006.01)
*F23R 3/10* (2006.01)

(52) U.S. Cl.
CPC ..... *F23R 3/005* (2013.01); *F23R 3/10* (2013.01)

(58) Field of Classification Search
CPC .. F23R 3/10; F23R 3/002; F23R 3/283; F23R 3/04; F23R 3/06; F23R 2900/03044;
(Continued)

(56) References Cited

U.S. PATENT DOCUMENTS 5,329,761 A * 7/1994 Ablett ..... F23R 3/10 60/804
7,043,921 B2 * 5/2006 Hadder ..... F23R 3/005 60/772

(Continued)

FOREIGN PATENT DOCUMENTS

EP 1785671 A1 5/2007
FR 2896575 A1 7/2007

(Continued)

OTHER PUBLICATIONS

International Patent Application No. PCT/FR2019/051176, International Search Report and Written Opinion dated Sep. 4, 2019, 14 pgs.

*Primary Examiner* — Gerald L Sung
*Assistant Examiner* — Rodolphe Andre Chabreyrie
(74) *Attorney, Agent, or Firm* — Lathrop GPM LLP

(57) ABSTRACT

The invention relates to a bottom wall (118) of a gas turbomachine combustion chamber. This bottom wall comprises openings (119) for mounting combustion air supply systems and holes (128) for the passage of cooling air between at least one inlet (128*a*) and at least one outlet of said holes. The holes (128) extend inwardly along the bottom wall with the outlet port located closer to the opening (119) adjacent to it than the inlet hole.

19 Claims, 6 Drawing Sheets

(58) Field of Classification Search
CPC ..... F23R 2900/03042; F23R 3/007;
F23R 3/005; F01D 25/08
See application file for complete search history.

(56) References Cited

U.S. PATENT DOCUMENTS

| | | | | |
|---|---|---|---|---|
| 11,029,028 | B2 * | 6/2021 | Bengtson | F23R 3/50 |
| 2004/0231333 | A1 | 11/2004 | Tiemann et al. | |
| 2017/0356652 | A1 | 12/2017 | Singh et al. | |
| 2019/0086081 | A1 * | 3/2019 | Bellardi | F23R 3/002 |

FOREIGN PATENT DOCUMENTS

| | | | |
|---|---|---|---|
| FR | 2998038 | A1 | 5/2014 |
| GB | 2053450 | A | 2/1981 |
| WO | WO 2018026382 | A1 | 2/2018 |

* cited by examiner

TURBINE ENGINE COMBUSTION CHAMBER BOTTOM

CROSS-REFERENCE TO RELATED APPLICATIONS

This application is a 35 U.S.C. § 371 filing of International Application No. PCT/FR2019/051176 filed May 22, 2019, which claims the benefit of priority to French Patent Application No. 1854298 filed May 23, 2018, each of which is incorporated herein by reference in its entirety.

BACKGROUND AND SUMMARY OF THE INVENTION

The invention relates to the field of turbomachine combustion chambers for aircraft.

In this field such combustion chambers are known, with:

- two inner and outer walls, respectively (also called inner and outer ferrules, or longitudinal walls), and
- a chamber bottom extending between said inner and outer walls and including first mounting openings for fuel air injection devices (in particular) to inject this oxidant through said openings.

A deflector is furthermore often arranged downstream of the bottom wall, in order to thermally protect it with respect to the hearth of the combustion chamber in which combustion takes place, the deflector having second openings for mounting said oxidant injection devices (i.e. configured for this purpose), the first and second openings then being a priori coaxial. As a reminder, the hearth of a combustion chamber is delimited by said longitudinal walls and the bottom of the chamber.

This is the case in EP 1 785 671.

Typically, two main functions of a deflector are to thermally protect the bottom of the chamber, which is often more structural, and to create a "cup" film for upstream cooling of the (surfaces facing the inside of the chamber of the) inner and outer walls, thanks to the impact flow coming from the pierced chamber bottom. Nevertheless, it turns out that this flow in the primary zone of the furnace (upstream part) disturbs the stability of the combustion and the early cooling of the internal and/or external walls accentuates the thermal gradient in the critical zone, around holes passing through them typically called primary and/or dilution holes For combustion in the hearth, fuel injection devices for injecting fuel through at least said first openings are also provided on these combustion chambers.

In the present application:

- axial has the following meaning: extending (substantially) parallel to the general axis of the combustion air supply (or injection) systems and of the fuel injector heads, which general axis is also that of said first aforementioned mounting openings;
- internal and external means (substantially) radially internal and radially external in regards to:
  - the longitudinal axis X around which the combustion chamber extends, for said longitudinal walls of the chamber, or
  - the aforementioned general axis (axis 122*a* below), for the other elements referred to in this text;
- the terms upstream and downstream are to be considered with reference to the general direction of air flow in the combustion chamber, the air concerned arriving from upstream (from the compressor(s)) and entering the combustion chamber through the bottom of the chamber with fuel, the gases resulting from the combustion leaving downstream and then passing into the turbine(s).

FR 2,998,038 discloses such a combustion chamber wherein there is a double-walled chamber bottom: upstream and downstream, the second one acting as a deflector, with a space (or enclosure) between them, this space being supplied with air via multiple perforations, in order to ensure impact cooling of the downstream wall, which is directly exposed to the flame radiation. Air is then ejected through slots or holes towards the (surfaces oriented towards the interior of the chamber of the) inner and outer walls to initiate an air film which is then relayed through the multi-perforation holes in these walls.

In the present patent, the chamber bottoms of such combustion chambers are concerned in particular.

A technical problem addressed here concerns the degradation of the in-service condition of the bottom of the chamber. Indeed, burns have been observed at the bottom of the chamber. Creeks were also observed.

In view of the analyses carried out, the thermal level of the exposure of these various parts seems to be the cause of the damage observed.

Indeed, the area concerned is massive and has a high thermal inertia. However, current technology makes it difficult to cool it.

Furthermore, in EP 1 785 671, the air passage holes are in the deflector plate and not in the (structural) chamber bottom wall. These air passage holes pass essentially between said chamber bottom wall and the deflector. It would be complicated to modify such a structure in order to pierce said chamber bottom wall, instead of the deflector, because said chamber wall has a role of mechanical structuring of the combustion chamber contrary to the deflector.

This allows to provide a solution to at least part of the above-mentioned difficulties that is proposed to upgrade an aircraft gas turbomachine combustion chamber comprising:

- longitudinal walls extending parallel to an axis (122*a* below),
- a hearth where combustion takes place,
- at least one bottom wall connected to said longitudinal walls and extending transversely thereto, the bottom wall comprising:
  - at least one axial opening,
  - holes passing through it, for the passage of cooling air between at least one inlet and at least one outlet of said holes, the holes extending along the bottom wall inside the same, the outlet being located closer to said at least one opening than the inlet, and
  - at an outer periphery, a curved portion forming a rim (or ledge), and
- at least one combustion air supply system comprising a bowl mounted in said at least one opening, or integral with said at least one bottom wall, with the important feature that at the location of said rim the bottom wall is fixed with the longitudinal walls.

By fixing together by this rim the chamber bottom wall (with its air passage holes along it) and the longitudinal walls (inner and outer walls mentioned above), an indirect thermal impact on these longitudinal walls is expected. Fixing can be carried out by means of screws.

The expression "along the chamber bottom wall" indicates that said holes extend (at least along most of their length) transversely to the thickness of the chamber bottom wall, internally. Considering a substantially flat area of this bottom wall, said holes extend, inside this wall, substantially in the plane of this wall, and therefore not transversely to this plane. When the bottom of the chamber extends (overall) between said inner and outer walls, said inner holes will extend (at least over most of their length) substantially transversely to the above-mentioned longitudinal axis of the combustion chamber In addition, these holes will favourably define (air) pipes. The expression "pipe" is intended to indicate that said holes will be favourably very long in relation to their cross-section(s), typically their diameter(s), this ratio thus being greater than 5, or preferably 10, even if said cross-section varies. The maximum cross section is then considered.

Each of these holes will thus be able to ensure a cooling air circulation fed by the highest pressure differential available. The air flow rate obtained will allow the recovery of calories by pumping them into the bottom of the chamber. In addition, the use of a deflector may be limited (see below).

Preferably, the inlet of the hole(s) in question should be located towards the outer periphery of the bottom wall of the chamber.

Thus, it will be possible to favour an easier realization (access through this periphery) and to benefit from a potentially longest length of holes, or pipes, with thus an optimised thermal effect.

Preferably, the combustion chamber:

which is adapted for air to flow through it, from upstream (AM) to downstream (AV; arrow 111 FIG. 2), passing successively:

in said at least one axial opening and said holes in the bottom wall, then, in the hearth, will be such that said rim is oriented upstream, said at least one inlet hole preferably being located towards a free end of the rim (thus possibly at a distance from the free end of the rim).

In addition to the above advantages, this rim can then be used to both fix the above-mentioned walls and to manage the above-mentioned thermal problem in an optimised way (by lengthening the length of the holes).

If the rim is facing upstream, it will also be easier to let in air, which will be cooler.

Preferably, said holes will open on the edge of the chamber bottom wall at the location of the inlet and/or outlet openings.

In this case, an easier execution and a longer hole length are all the more preferable, respectively. In addition, opening the outlet openings of the holes on the (radially inner) edge of the chamber bottom wall, or at least in the immediate environment of said (each) mounting opening of the combustion air supply system(s), will allow the air flow obtained, having recovered calories by pumping in the chamber bottom, to open into the chamber (hearth inlet) to supply the combustion. It should be noted that such heated air will be beneficial for the stability of combustion, as the pipes (holes) are fed by the highest pressure differential available.

At least some of said holes may individually define a sinuous line over at least part of their length.

Thus, it will be possible to aim for the holes/ducts to be made as accurately as possible so that the bottom wall of the chamber ensures both a structural function and efficient cooling. Thus, a sinuous shape will make it possible to keep a constant material thickness (at least sufficient) and to maximize the exchange surface in order not to create mechanical weakness or areas likely to favour hot spots. It will help to take into account the problems of thermal homogenization of the bottom of the chamber and its lifetime.

This also applies to a combustion chamber of an aircraft gas turbomachine, in itself, comprising:

said longitudinal walls, a hearth where combustion takes place, at least one said chamber bottom wall, with all or some of the above characteristics, connecting these longitudinal walls, and at least one said combustion air supply system comprising a bowl mounted in said at least one opening, or integral with said at least one bottom wall of the chamber provided therewith.

Preferably, the combustion air supply system(s) will also comprise at least one supply passage towards an outer periphery of the bowl, and/or at least one twist, respectively provided to be supplied with: combustion air to be supplied to the inside of the bowl mixed with air having passed through said second holes.

Thus, in particular with the outlet openings of the above-mentioned air holes opening onto the (radially inner) edge of the chamber bottom wall, or at least in the immediate environment of said mounting opening(s) of the combustion air supply system(s), it will be possible, in addition to recovering calories by pumping them into the chamber bottom, to supply the combustion with this heated air, which is therefore favourable to the stability of the combustion.

In relation to the above, it is proposed that the above-mentioned bowl be (typically at the location of a flared part) crossed by second holes and/or third holes for the passage of fluid (a priori only air). These second holes and/or third holes will open into the hearth of the combustion chamber and, close to them, at least some of the outlet openings (of at least some) of said holes made in the bottom wall of the chamber will be able to open there, so that (heated) air having passed through these holes can also pass through said second and/or third holes, thus towards said hearth.

In connection with the aforementioned aspect concerning the combined effect of fixing said chamber bottom wall and of thermal management in the environment of this fixing, it is proposed that at the location of a said rim formed, at the outer periphery of the wall, by a curved part, said at least one chamber bottom wall be fixed with the longitudinal walls by screws which will bypass some of said holes/ducts of the chamber bottom wall.

With a combustion chamber having all or part of the aforementioned characteristics, it is thus possible to have a chamber bottom wall which directly faces the inner hearth of the chamber, without the interposition of a deflector plate, impliedly disposed opposite, slightly downstream of said bottom wall, like it transversely to said inner and outer walls.

In fact, with a chamber bottom wall without transverse (i.e. substantially axial) holes for the cooling air (holes referred to above as "multi-perforations"), it will be possible to make such a wall and a deflector in one piece. The film cup function could then be removed and the thermal and structural functions could be provided by the one-piece chamber bottom. The weight saving compared to separate parts would depend on the cooling requirements and mechanical strength.

Thus, it is further proposed that the manufacture of said chamber bottom wall be carried out by additive manufacture, providing for the manufacture of said holes in this wall with a section smaller than the remaining thickness of said bottom wall on either side of this section.

It will then become possible to integrate a network of holes forming pipes in a fairly small space, with an expected mass gain and efficient and optimised cooling of critical areas. The additive manufacturing shall allow for the construction of said holes/ducts as accurately as possible to ensure both the structural function and the cooling function of the bottom of the chamber. Thus, possible sinuous shapes such as those mentioned above make it possible to maintain a constant material thickness and to maximise the exchange surface in order to avoid creating mechanical weakness or areas likely to favour hot spots.

The invention will be better understood and other details, characteristics and advantages of the invention will appear when reading the following description, which is given as a non-limiting example, with reference to the attached drawings.

DETAILED DESCRIPTION

Figure 1:
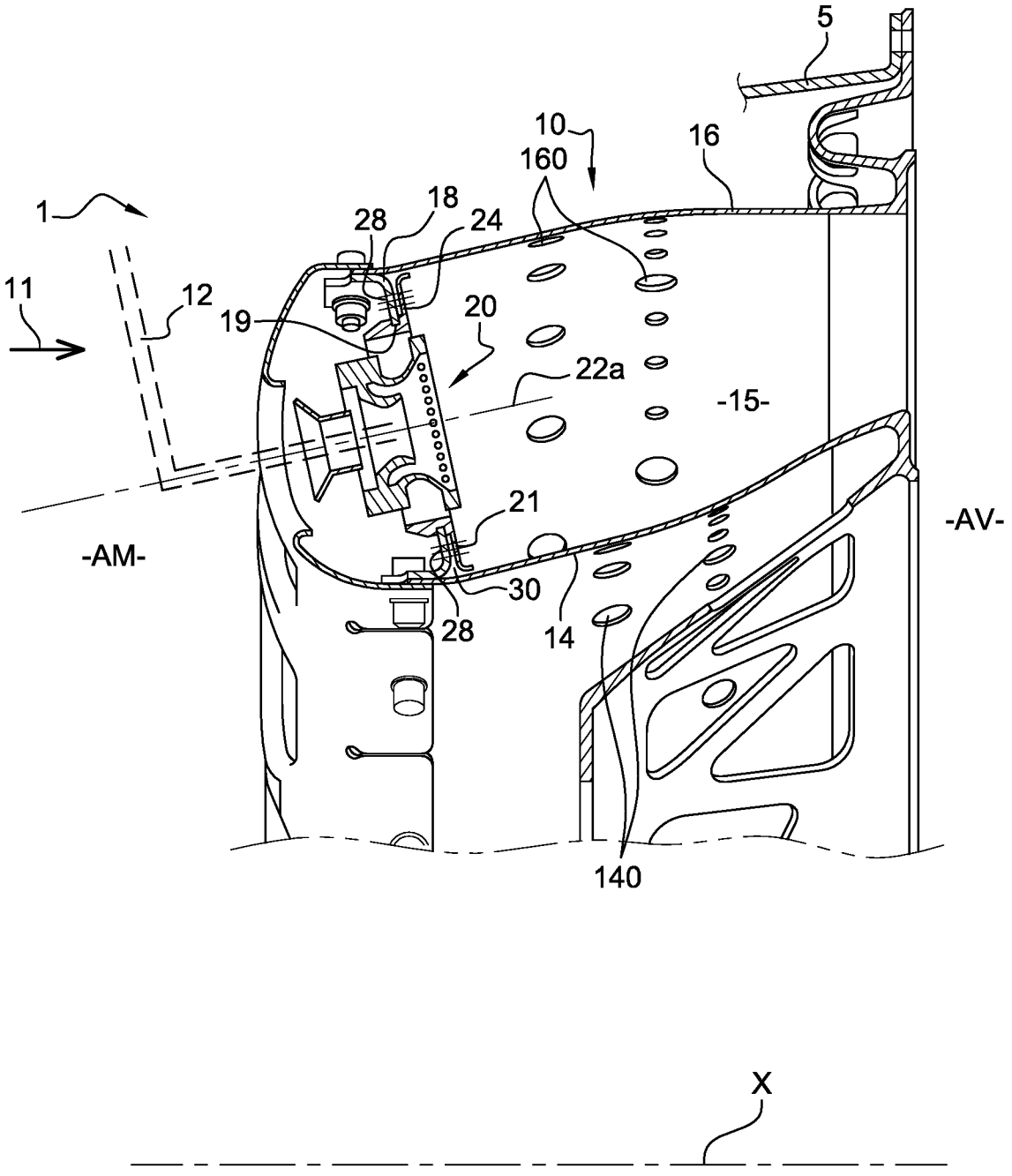
FIG. 1 is a diagram of a gas turbomachine combustion chamber according to the previous art.

FIG. 1 shows a combustion chamber 10 of an aircraft gas turbomachine 1 in accordance with the prior art. Turbomachine 1 has, upstream (AM) with respect to the overall direction of gas flow in the turbomachine (arrow 11 a compressor not shown, in which air is compressed before being injected through a diffusion ring duct into a chamber external housing 5 and then into the combustion chamber 10 mounted in this external housing 5. The compressed air is fed into the combustion chamber 10 and mixed with fuel before coming from injectors 12. The gases from the combustion are directed to a high pressure turbine not shown, located downstream (AV) of the outlet of chamber 10. Combustion chamber 10, which is of the annular type, comprises a radially inner annular wall 14 and a radially outer annular wall 16 (also called longitudinal walls), whose upstream ends are connected by a substantially radially extending bottom wall 18. The bottom wall 18 has a plurality of axial openings 19 for the installation of combustion air injection devices 20 also known as combustion air supply systems. In addition, fuel injector heads 12 are engaged in front of openings 19. Holes 140 and 160, for the circulation of dilution and/or cooling air can pass through the inner 14 and/or outer 16 walls, respectively.

The longitudinal walls 14 and 16 may be substantially coaxial with each other and parallel to axis 22*a*, this axis belonging to the sectional plane of FIGS. 1, 2 and 9-11 and thus being the general axis of alignment of each combustion air injection device and each associated fuel injector head 12. Combustion chamber 10, on the other hand, develops annularly around the X axis which is the general axis of turbomachine 1 around which the rotating elements of the compressor(s) and turbine(s) rotate. In the example, there is an acute angle between the X and 22*a* axes. These two axes could be parallel. The bottom 18 of combustion chamber 10 also has deflectors 24 mounted downstream of the bottom wall 18 to protect it from the flame formed in the hearth 15 in the combustion chamber 10 defined between the walls 14, 16. The deflectors 24 are arranged in successive sectors around the X axis, adjacent to each other at their lateral edges, so as to form an annular ring of deflectors.

The bottom wall 18 has multi-perforations 28 for the passage of air from the compressor into the annular space 30 between the bottom wall 18 and the deflectors 24. The ventilation of the bottom wall 18 may not be homogeneous over its entire circumference.

In FIGS. 2-11, which illustrate several embodiments of the invention, respectively in one or several pieces, with different piercings, the identical parts, and/or with identical functions, to those presented in relation to FIG. 1 have the same mark, increased by 100.

Thus, it can be seen that, in all the modes of construction detailed below, there is, as in FIGS. 2-11, an annular combustion chamber bottom wall 118 connecting together, by means of fasteners (such as screws 32), the longitudinal walls 114, 116 substantially transversely to them. The back wall 118 has:

- openings 119 for the installation of combustion air supply systems 120,
- and through holes 128 for the passage of cooling air between at least one inlet hole 128*a* and at least one outlet port 128*b* thereof.

Furthermore, in an attempt to overcome at least some of the problems and disadvantages mentioned above, it is in the proposed invention that, as already explained, the cooling air passage holes 128 through the bottom wall 118 extend internally along this bottom wall, between at least one said inlet hole 128*a* and at least one said outlet port 128*b*.

Figure 4:
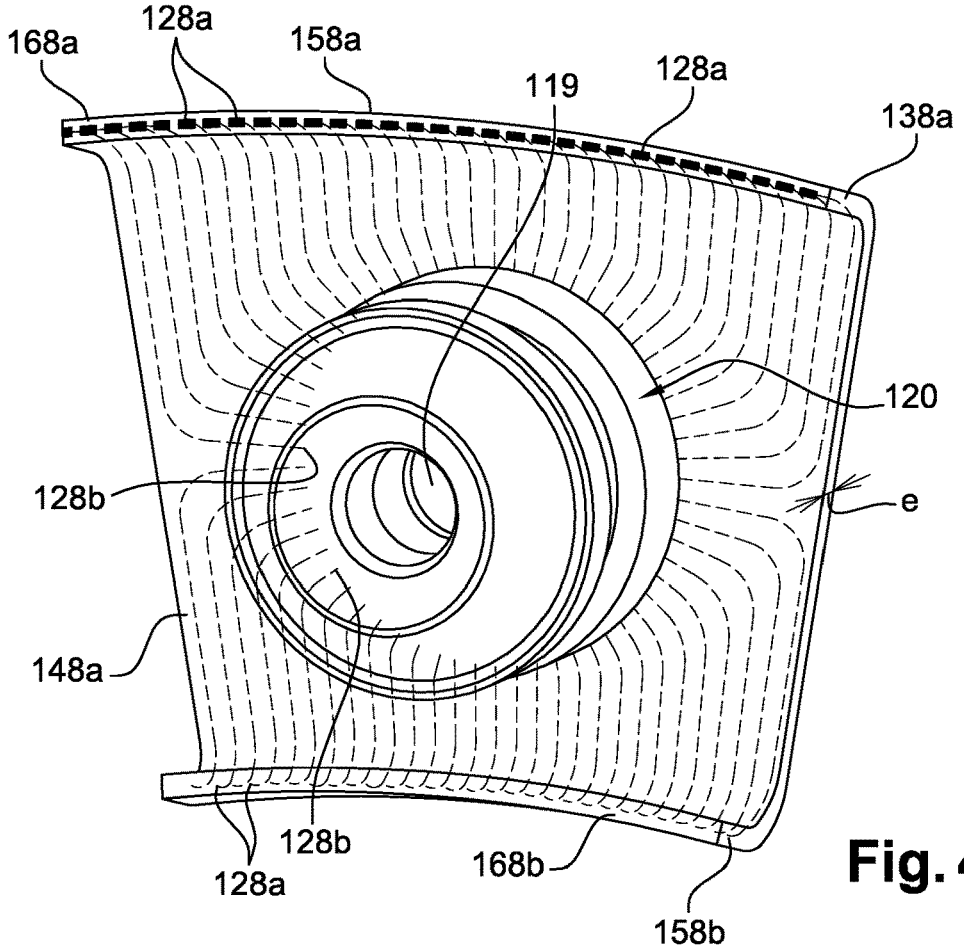
FIG. 4 is an enlarged diagram of this area of the bottom wall.

With respect to the opening 119 most adjacent to it, outlet port 128*b* is located closer to opening 119 than inlet hole 128*a*, as shown in FIG. 4.

Thus, at least part of these cooling air holes 128 will pass through (internally along) the total thickness e of the bottom wall 118.

To achieve this, it will certainly be favourable in practice to locate the (each) inlet hole 128*a* towards an outer periphery 178*a* (external to the axis 122*a*) of said bottom wall 118.

Figure 3:
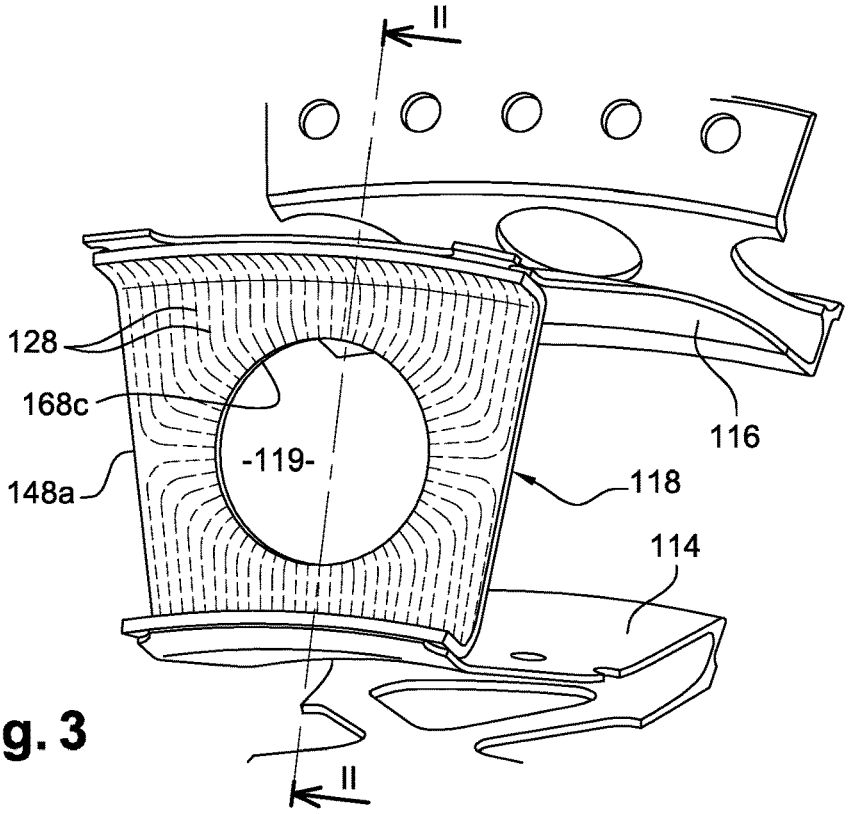
FIG. 3 is a diagram of a sector of this bottom wall fixed with said inner and outer walls of said chamber.

Rather than being a single piece over 360°, the bottom wall 118 preferably comprises, around the axis 122*a*, a circumferential succession of wall sectors 148*a* each provided with an opening 119; see in particular FIG. 3.

For its fastening, the bottom wall 118 has, at its outer periphery, an annular rim 138*a* for fastening to the upstream end of the outer wall 116 of the chamber, and, at its inner periphery, an annular rim 138*b* for fastening to the upstream end of the inner wall 114 of the chamber.

A priori, it will be preferred that the annular rims 138*a* external and 138*b* internal face upstream. They may be substantially cylindrical.

Figure 5:
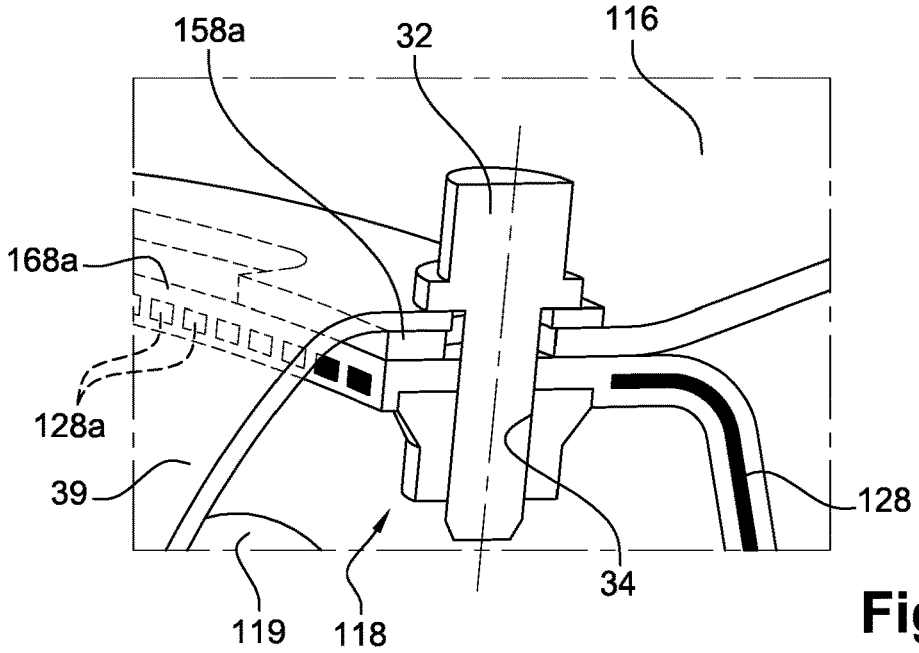
FIG. 5 shows a bypass of a fixing screw.

The fixing itself is, in the preferred example, by means of screw-nut type means 32 which pass through holes 34 in the rims 138*a*, 138*b*, radially to axis 122*a*; see FIG. 5.

In order to combine fixing and cooling qualities, it is proposed that some of said holes 128 in the bottom wall bypass screws 32 (and their holes 34); FIG. 5.

Figure 6:
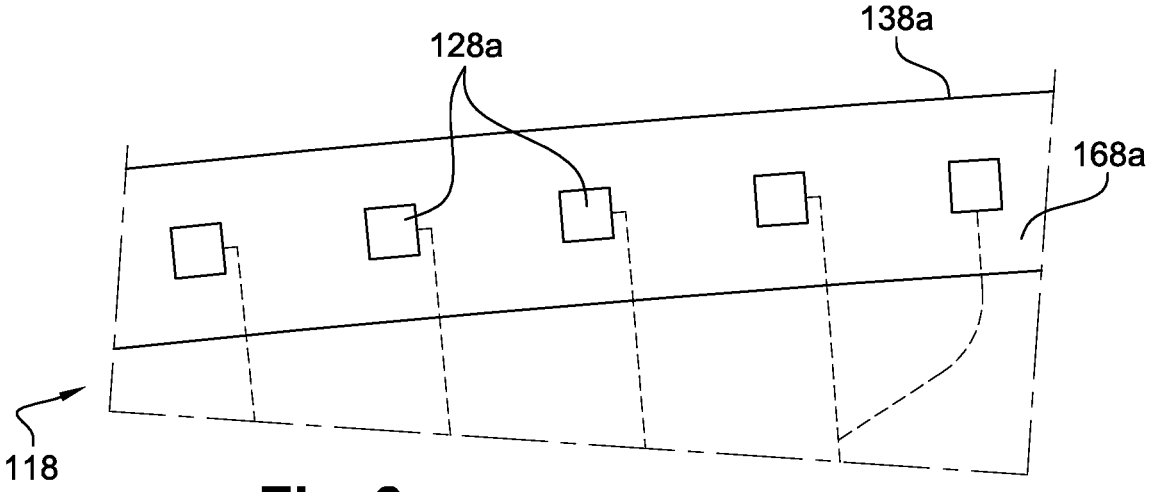
FIGS. 6, 7 show the shapes of the so-called holes or air ducts passing through the chamber bottom wall, FIG. 7 also showing a local enlargement.

In particular, it is towards the respective upstream free ends 158*a*, 158*b* of these mounting rims 138*a*, 138*b* that the inlet holes 128*a* of the above-mentioned cooling air passage holes 128 will be located; see FIGS. 5, 6.

Thus, it is then away from the hot and fixing areas, from the free edge 168*a* and/or 168*b* of these fixing rims 138*a*, 138*b*, that the cooling air can circulate in wall 118.

Figure 9:
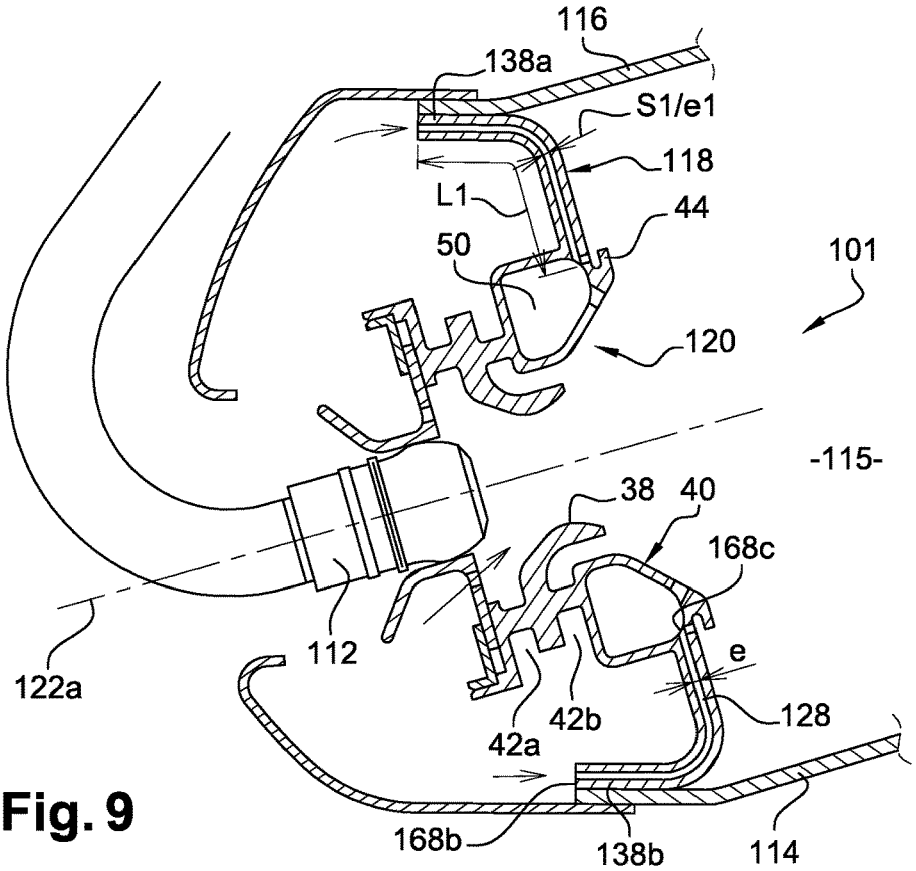
FIGS. 9, 10 and 11 are variants of the embodiment in FIG. 2.

Towards the outlet, after conducting the air, holes 128 may also lead to the inner edge 168*c* of the back wall; see FIGS. 3, 9.

This will allow the bottom wall 118 to be cooled as thoroughly as possible, sector by sector, if it is formed in this way.

In the thickness of the bottom wall 118, the cross-section of the holes 128 may be constant or variable. It could be rectangular (FIG. 6) or circular (FIG. 7), for example.

Figure 2:
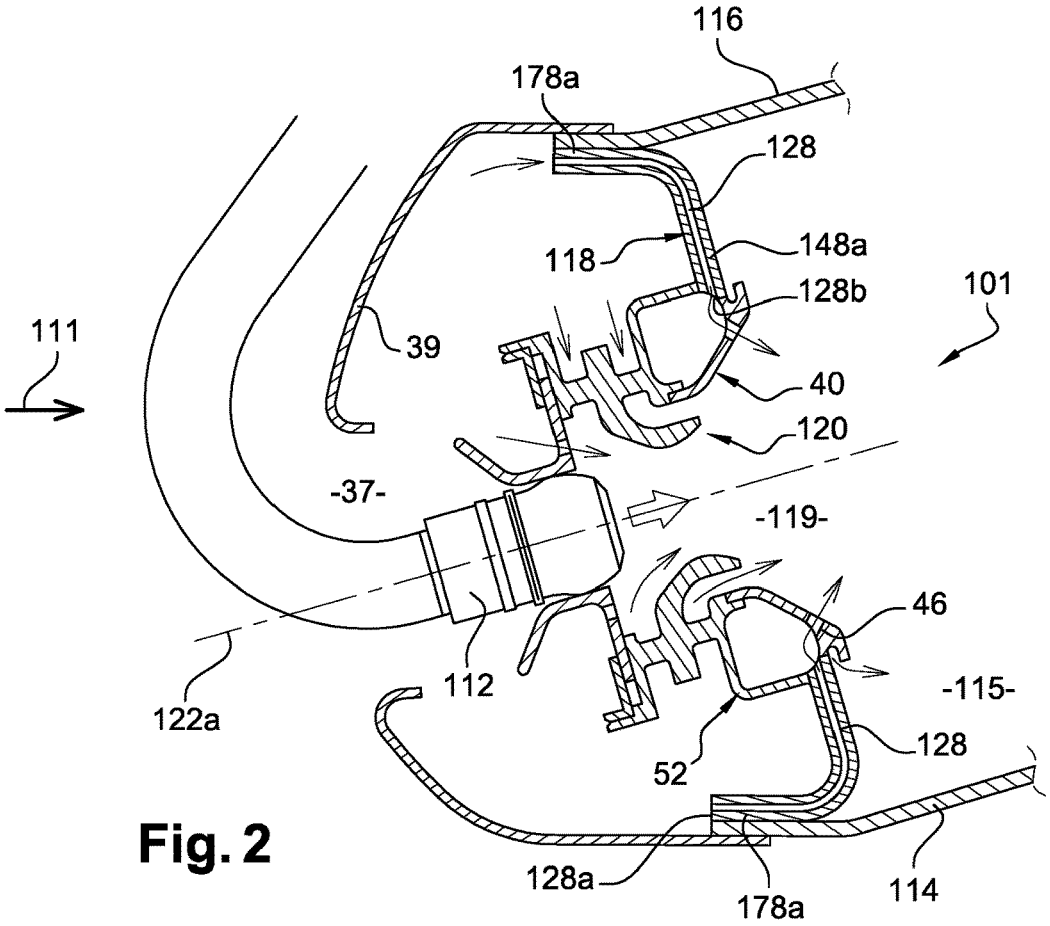
FIG. 2 is a section in direction II-II of FIG. 3 of an upstream part of a gas turbomachine combustion chamber with a bottom wall according to the invention.

On this point, it can be seen from most of FIG. 2 and following ones that holes 128 are, as preferred, very long in relation to their cross-section (whether single or variable), this ratio being greater than 5, or even preferably 10, even if said cross-section varies. The maximum cross section is then considered. The term "duct" is intended to mark this ratio length (L)/section (S)>5, as shown in FIG. 5, for example.

The number of inputs 128*a* and the number of outputs 128*b* will be defined according to the needs. An input will not necessarily correspond to a single output, and vice versa. For example, there may be a single, long-slotted inlet 128*a*, internal connections 36 at the bottom of the chamber (FIG. 7) or outlets at different locations; for example, an outlet at the air injection system (bowl holes and rim) and an outlet along the wall 118.

Figure 8:
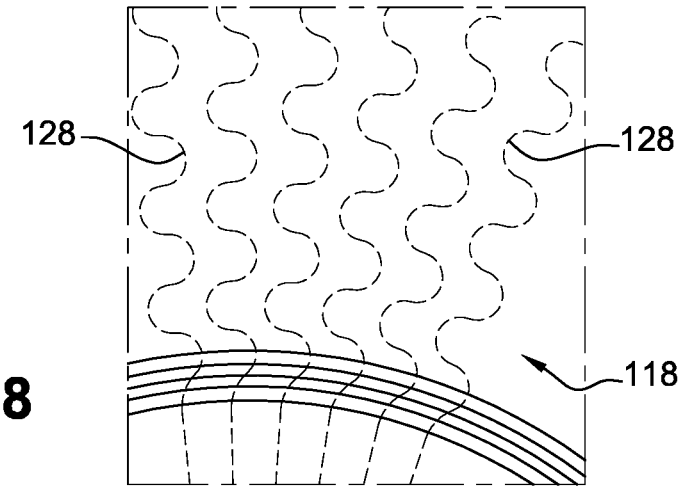
FIG. 8 is a sinuous shape diagram of such holes or air ducts.

Notably by additive manufacturing (one of the manufacturing processes, most of the time computer-assisted, aiming at shaping a part by adding material, by stacking successive layers), it will be possible to fabricate/construct holes/ducts 128 to ensure as precisely as possible both the structural function and the cooling function of the bottom 118 of the chamber. It will thus be possible for at least some of these holes or ducts to individually define a sinuous line, over at least part of their length, as shown in FIG. 8, thus making it possible to maintain a constant material thickness and to maximise the exchange surface so as not to create mechanical weaknesses or areas likely to favour hot spots.

Figure 7:
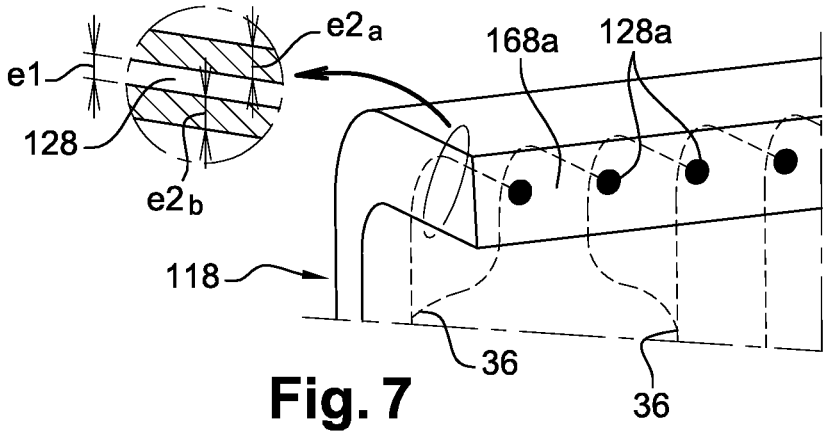

With additive manufacture, it will be possible in particular to manufacture the holes/ducts 128 of wall 118 with a section e1 (such as a diameter) smaller than the remaining thickness (e2*a*+e2*b*) of said bottom wall, on either side of this section; i.e. e1<e2*a*+e2*b*; FIG. 7. This will allow:

- to assemble a chamber bottom and a deflector in one piece, and that the holes/ducts 128 be fed by the largest pressure differential available, and
- to make holes/ducts 128 of very small diameter, over a distance of several cm in the workpiece, and for possibly non-rectilinear trajectories.

Diameters e1 of holes/ducts 128 smaller than a millimetre must make it possible to maintain a thickness (e2*a*+e2*b*) at the bottom of the chamber that is low and to ensure a structural role. A minimum thickness of material will thus be preserved. These diameters will be favourably in the range of one quarter to one third of the total thickness (e1+e2*a*+e2*b*) of the chamber bottom.

FIGS. 2 and 9-11 schematically detail the environment of chamber bottom wall 118. For example, combustion chamber 101 is fuelled by liquid fuel mixed with air. The liquid fuel is supplied to it by the fuel injector heads 112 engaged opposite (just upstream) of the openings 119, along each axis 122*a*, after having each passed through the axial opening 37 of an annular cowling 39 fixed peripherally to the walls 114, 116. Initiated at the injector, fuel vaporization is continued at a venturi 38 and a pre-evaporation bowl 40 of generally annular, typically frustoconical shape, by the effect of the pressurised air coming from the aforementioned compressor. To pass through the relevant opening 119, the pressurised air passes through one or more radial twists 42 of the corresponding system 120, in order to ensure that the fuel sprayed by the fuel injector head 112 coaxial to the relevant system 120 is set in rotation. Each radial spin may consist of an upstream 42*a* spin and an adjacent downstream 42*b* spin. Each bowl 40 may have a rim 44 at the downstream end forming an outer rim, which may be radial. The twists could also be axial.

Figure 10:
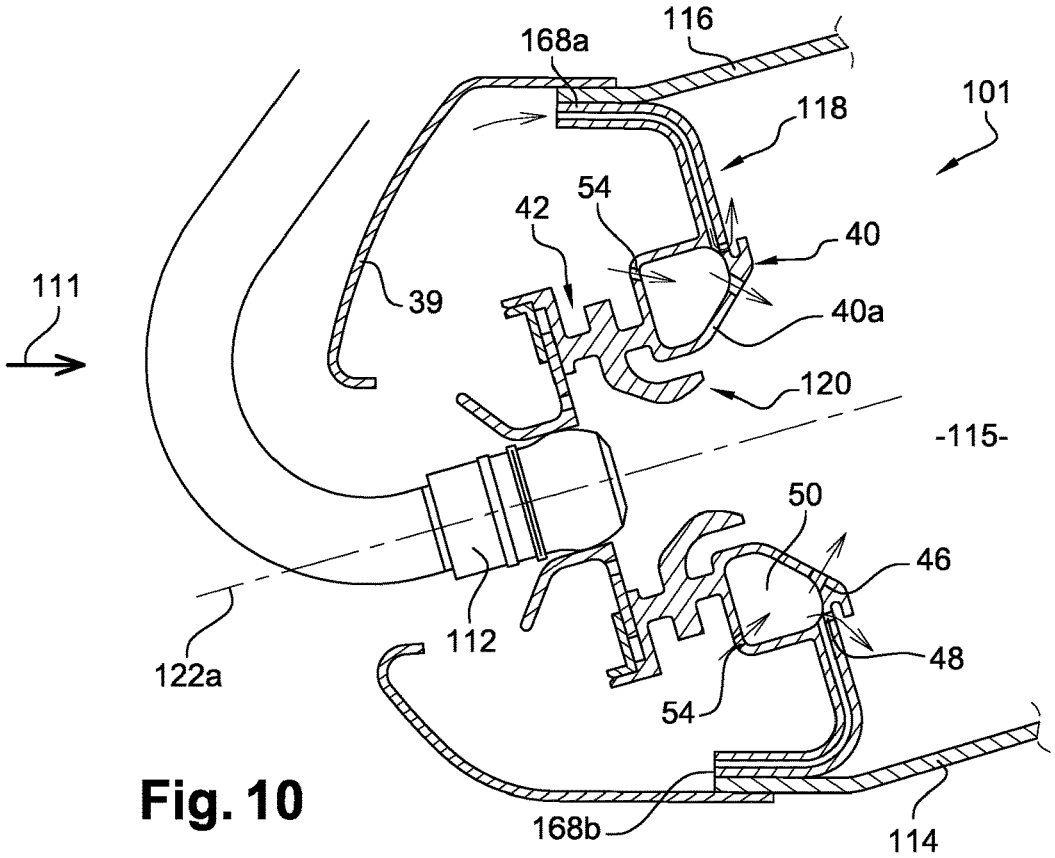
Figure 11:
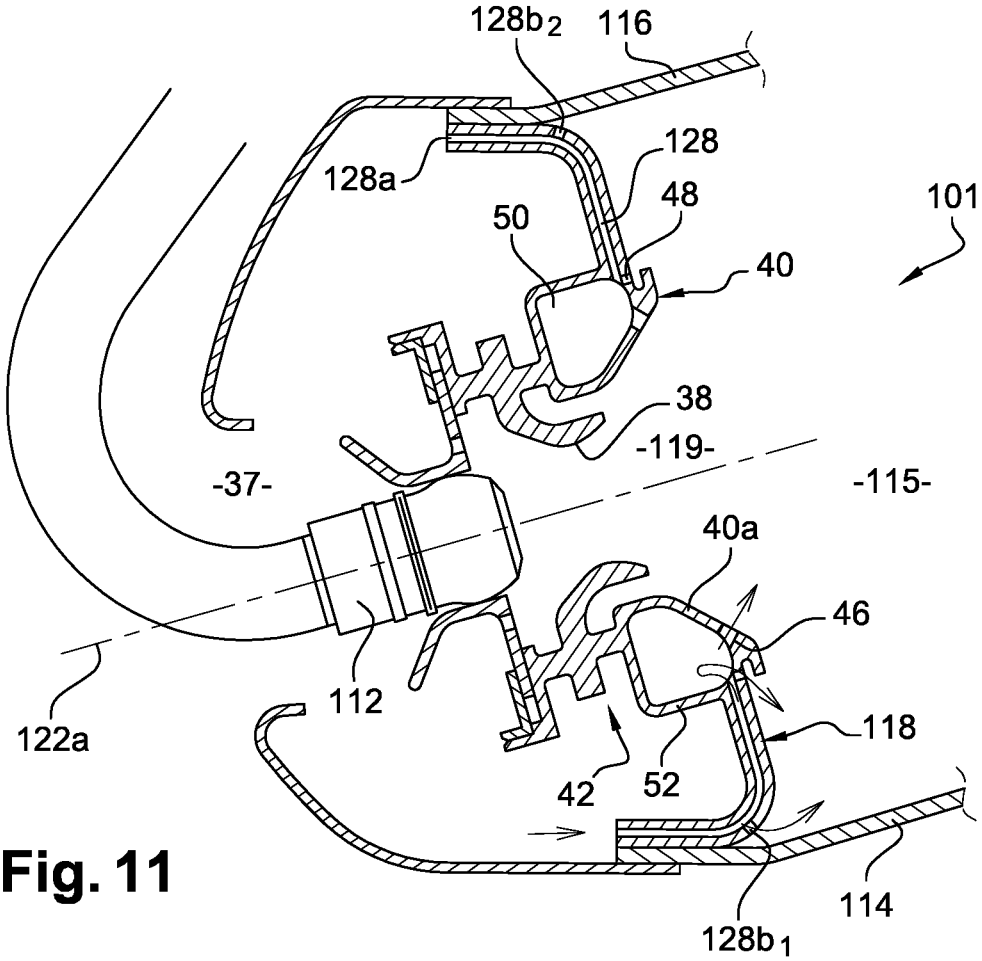

FIGS. 2, 10-11 show, by single arrows, different air supply paths to hearth 115 and FIG. 2, by a double arrow, a fuel supply path to hearth 115, which extends axially from chamber bottom wall 118, between the longitudinal walls 114, 116.

Each bowl 40 of the combustion air supply system 120 is mounted in (or surrounds, in a one-piece construction; see below) the opening 119 of one of the sectors of the chamber bottom wall 118.

Air and fuel flows through bowl 40 to ignite in the hearth 115.

From the upstream compressed air (arrow 11), the cooling compressed air which has circulated through the holes/ducts 128, can exit through:

- second holes 46 passing through bowl 40 obliquely in the direction of axis 22*a*, and/or
- of the third hole 48 also passing through bowl 40, just opposite rim 44, to cool it, by impact.

The third holes 48 are substantially parallel to axis 122*a*.

Before passing through the second 46 and third holes 48, the air that has circulated through the holes/ducts 128 should preferably be discharged through the edge of wall 118, in 128*b* (see FIGS. 2, 9-11), in order to supply an intermediate air distribution chamber 50, annular around the axis 122*a*. The distribution chamber 50 is closed upstream by an angled wall 52 connected to both wall 118, towards its inner edge, and to bowl 40.

The elbow wall 52 can be traversed by at least one supply passage 54 in distribution chamber 50 for air from stream 111 that has not passed through the holes/ducts 128.

Thus, each combustion air supply system 120 may comprise at least one said supply passage 54 towards an external periphery of the bowl, and/or at least one twist 42, provided respectively to be supplied with combustion air to be supplied to the inside of the bowl 40, mixed with the air, coming from the bottom wall 118 of the chamber, and thus having passed through the second holes 46, for a supply of air directly to the location of the opening 119 in question.

The relevant outer periphery of bowl 40 and the second holes 46 will be favourably located in its downstream flared part 40*a*, in order to distribute the air/fuel mixture in the hearth 115.

If it is also desired to create a "cup" film for upstream cooling of the (so-called chamber-facing surfaces of the) inner 114 and outer 116 walls, thanks to an impact flow coming from the bottom of chamber 118, some of the outlets 128*b*, such as those 128*b*1, 128*b*2 on FIG. 11, will be able to pass through a remaining thickness of wall 118, across this thickness therefore. These outlets 128*b*1, 128*b*2, connected to the holes/ducts 128, will be close to the rims 138*a*, 138*b*, while being directed downstream, in close proximity to the inner 114 and outer 116 walls, respectively.

In all of the above examples (see FIGS. 2, 9-11), the back wall 118 faces directly in front of the inner hearth 115, without the interposition of a deflector plate, unlike the solution in FIG. 1.

In addition to the additive manufacturing which may have allowed it (see above), this specificity is of course linked to the holes/ducts 128.

For the connection between the back wall 118 and the combustion air supply system 120, several cases have been provided for:

first, the back wall 118 and system 120 can be welded together (e.g. soldered); see FIG. 2, alternatively, the back wall 118 and system 120 can be made in one piece (especially in case of additive manufacture); see FIGS. 9, 10-11.

In both cases, wall 118 was connected to the outer face of the flared part 40*a* of bowl 40 and to the downstream end of the angled wall 52 towards the circumference of opening 119. In order to form the annular chamber 50, the upstream ends of bowl 40 and angled wall 52 were also joined together.

The invention claimed is:

1. A combustion chamber of a gas turbomachine for an aircraft, comprising:

longitudinal walls extending parallel to an axis, a combustion zone where combustion is allowed to take place, a bottom wall having a surface, the bottom wall being secured to said longitudinal walls and extending transversely thereto, the bottom wall comprising:

at least one axial opening, a series of first air passage holes for passing cooling air, each first air passage hole extending through the bottom wall, inside the bottom wall, between an inlet open in an area located upstream of the bottom wall and an outlet open in an annular intermediate cooling air distribution chamber located around the axis, the annular intermediate cooling air distribution chamber being in gaseous communication with the series of first air passage holes and the combustion zone, the outlets being located closer to said at least one axial opening than the inlets, and at an outer periphery, a curved portion forming a rim, and at least one combustion air supply system comprising a bowl mounted in said at least one axial opening, or integral with said bottom wall, wherein:

at the location of said rim the bottom wall is fixed with the longitudinal walls, the combustion chamber is adapted to allow cooling air to flow through the combustion chamber from upstream to downstream, passing successively:

in said at least one axial opening and said first air passage holes, then, in the combustion zone, and said rim is oriented upstream, said inlets being located towards a free end of the rim.

2. The combustion chamber according to claim 1, wherein the inlets of the first air passage holes are located toward the outer periphery of said bottom wall.

3. The combustion chamber according to claim 1, wherein said first air passage holes open onto a free edge of the bottom wall, at the location of the respective inlets and/or outlets.

4. The combustion chamber according to claim 2, wherein said first air passage holes open onto a free edge of the bottom wall, at the location of the respective inlets and/or outlets.

5. The combustion chamber according to claim 1, wherein at least some of said first air passage holes individually have a length along said surface and define a sinuous line over at least a portion of said length.

6. The combustion chamber according to claim 2, wherein at least some of said first air passage holes individually have a length along said surface and define a sinuous line over at least a portion of said length.

7. The combustion chamber according to claim 3, wherein at least some of said first air passage holes individually have a length along said surface and define a sinuous line over at least a portion of said length.

8. The combustion chamber according to claim 4, wherein at least some of said first air passage holes individually have a length along said surface and define a sinuous line over at least a portion of said length.

9. The combustion chamber according to claim 1, wherein:

the bowl is traversed by second air passage holes and/or third air passage holes, the second air passage holes and/or the third air passage holes open into the combustion zone, and in the vicinity of the second air passage holes and/or the third air passage holes, at least some of said outlets open out so that air having passed through said first air passage holes is also allowed to pass through said second air passage holes and/or third air passage holes.

10. The combustion chamber according to claim 2, wherein:

the bowl is traversed by second air passage holes and/or third air passage holes, the second air passage holes and/or third air passage holes open into the combustion zone, and in the vicinity of the second air passage holes and/or third air passage holes, at least some of the outlets open out so that air having passed through said first air passage holes is also allowed to pass through said second air passage holes and/or third air passage holes.

11. The combustion chamber according to claim 3, wherein:

the bowl is traversed by second air passage holes and/or third air passage holes, the second air passage holes and/or third air passage holes open into the combustion zone, and in the vicinity of the second air passage holes and/or third air passage holes, at least some of the outlets open out so that air having passed through said first air passage holes is also allowed to pass through said second and/or third air passage holes.

12. The combustion chamber according to claim 4, wherein:

the bowl is traversed by second air passage holes and/or third air passage holes, the second air passage holes and/or third air passage holes open into the combustion zone, and in the vicinity of the second air passage holes and/or the third air passage holes, at least some of the outlets open out so that air having passed through said first air passage holes is also allowed to pass through said second and/or third air passage holes.

13. The combustion chamber according to claim 9, wherein said at least one combustion air supply system also comprises at least one supply passage towards an outer periphery of the bowl, and/or at least one twist, respectively adapted to be supplied with combustion air to be supplied to the inside of the bowl mixed with air having passed through said second air passage holes.

14. The combustion chamber according to claim 10, wherein said at least one combustion air supply system also comprises at least one supply passage towards an outer periphery of the bowl, and/or at least one twist, respectively adapted to be supplied with combustion air to be supplied to the inside of the bowl mixed with air having passed through said second air passage holes.

15. The combustion chamber according to claim 1, wherein, at the location of the rim, said at least one bottom wall is secured with the longitudinal walls by screws which are circumvented by some of said first air passage holes.

16. The combustion chamber according claim 1, wherein said bottom wall directly faces the combustion zone.

17. A method of manufacturing, by additive manufacture, the bottom wall of the combustion chamber according to claim 1, in which said first air passage holes are made with a cross-section smaller than a remaining thickness of said bottom wall, on either side of the first air passage holes.

18. The combustion chamber according claim 1, wherein the annular intermediate cooling air distribution chamber extends around a flared wall of the bowl.

19. A combustion chamber of a gas turbomachine for an aircraft, comprising:

longitudinal walls extending parallel to an axis, a combustion zone where combustion is allowed to take place, at least one bottom wall connected to said longitudinal walls and extending transversely thereto, the bottom wall comprising:

at least one axial opening, first air passage holes passing through the bottom wall, for passing cooling air between inlets and outlets of said first air passage holes, the first air passage holes extending through the bottom wall, inside the bottom wall, the outlets being located closer to said at least one axial opening than the inlets, and at an outer periphery, a curved portion forming a rim, and at least one combustion air supply system comprising a bowl mounted in said at least one opening, or integral with said at least one bottom wall, wherein:

at the location of said rim the bottom wall is fixed with the longitudinal walls, the combustion chamber is adapted to allow air to flow through it from upstream to downstream, passing successively:

in said at least one axial opening and said first air passage holes, then, in the combustion zone, and said rim is oriented upstream, said inlets being located towards a free end of the rim, and wherein:

the bowl is traversed by second air passage holes and/or third air passage holes, the second air passage holes and/or the third air passage holes open into the combustion zone, and in the vicinity of the second air passage holes and/or the third air passage holes, at least some of said outlets open out so that air having passed through said first air passage holes is also allowed to pass through said second air passage holes and/or third air passage holes.

* * * * *